United States Patent [19]

Raschke

[11] 4,048,921

[45] Sept. 20, 1977

[54] ELECTROSTATIC PRINTING/DUPLICATING METHOD USING POLARIZATION FORCES

[75] Inventor: Curt R. Raschke, Somerset, N.J.

[73] Assignee: Addressograph-Multigraph Corporation, Cleveland, Ohio

[21] Appl. No.: 614,502

[22] Filed: Sept. 18, 1975

Related U.S. Application Data

[63] Continuation-in-part of Ser. No. 447,170, March 1, 1974, abandoned.

[51] Int. Cl.[2] ..... B41M 1/22

[52] U.S. Cl. ..... 101/426; 101/DIG. 13; 346/153

[58] Field of Search ..... 101/DIG. 13, 426; 346/74 ES; 355/17

[56] References Cited

U.S. PATENT DOCUMENTS

| | | | |
|---|---|---|---|
| 2,919,170 | 12/1959 | Epstein | 101/DIG. 13 X |
| 3,012,839 | 12/1961 | Epstein et al. | 101/DIG. 13 X |
| 3,519,461 | 7/1970 | Stowell | 346/74 ES |
| 3,804,511 | 4/1974 | Rait et al. | 355/17 |

*Primary Examiner*—Edgar S. Burr

*Assistant Examiner*—R. E. Suter

*Attorney, Agent, or Firm*—Ray S. Pyle

[57] ABSTRACT

A belt of flexible metal with a dielectric of good electrostatic charge retention properties bonded to it is guided over grounded metal rollers with the metallicized side in contact with the rollers. At an imaging station an electrostatic image is placed directly on the dielectric.

As the belt moves past a toning station it is sprayed with an insulating fluid containing small particles of high dielectric constant, which thereby obtain an induced dipole moment, or particles with a permanent dipole moment may be used. These particles are suspended in an organic carrier which is chosen so as not to discharge the dielectric belt and to impart a negligible electrostatic charge to the particles.

Then the developed image is moved past a station wherein a dielectric roller is used as a backup, and a sheet of plain paper is pressed between the belt and the roller to transfer the wet particles from the belt to the paper.

Because the image charge is never neutralized or electrostatically degraded, the belt can be developed and used to print new images many times without having to replace the image charge.

2 Claims, 2 Drawing Figures

ELECTROSTATIC PRINTING/DUPLICATING METHOD USING POLARIZATION FORCES

This application is a continuation-in-part of application Ser. No. 447,170; filed Mar. 1, 1974 and now abandoned.

BACKGROUND OF THE INVENTION

It is difficult, using standard electrophotographic techniques, to make any useful number of copies of an original document. Either the entire process must be repeated for the required number of times, or else an electrophotographic lithographic master must be made which can print the multiple copies. The former process is time consuming and expensive since the entire process must be repeated for each copy. The latter is economical only for relatively large numbers of copies since the master cannot be reused and an offset printing press is required in addition to the electrophotographic apparatus.

There are techniques in the literature which offer hope of improved performance, which have not as yet been brought to acceptable levels of commercial acceptance.

A process which can tone and transfer the toned image to plain paper and then retone and retransfer the image, without the need to reimage, has economic advantage. Because the latent image bearing insulator would not have to be resensitized and reimaged, the commercial process of making multiple copies would be greatly simplified and economies realized. In addition, the need for a master would be eliminated.

Previous techniques for accomplishing this have been severely limited in the number of usable copies which could be made, since the electrostatic latent image is inevitably degraded in the retoning and retransfering steps. Either there is uniform corona breakdown between the paper and latent image during the transfer step or the developer mix is sufficiently conductive to discharge the latent image during the toning step. Both of these problems inherently limit the number of copies which can be made with reimaging the photoconductor or image bearing dielectric.

PRIOR ART

All the standard development techniques contact the charged latent image with toner particles which carry a charge opposite in sign to that on the latent image. The opposite charges then attract each other through the well-known Coulomb's Law, causing the toner particles to be attracted only to the charged portions of the latent image. As taught by all textbooks on electricity, this Coulombic attraction is one of the strongest forces in nature. It is the large strength of the charged image to toner bond which is at the root of the well-known problems of making multiple copies from a single latent image. Any force strong enough to break the bond in the transfer to plain paper step inevitably degrades the original latent image, rendering it less suitable for retoning.

For example, one standard method of transfer is to contact the toned image with the plain paper and spray the back of the paper with a corona of charge sign the same as that on the latent image. This process usually obliterates the latent image after the first copy is made. The charge leaking through the paper, and that caused by the air breakdown resulting from the separation of the charged paper from the charged dielectric, uniformly charges the dielectric, destroying the latent image. The use of electrically biased transfer rollers allows more than one copy to be made, but the latent image surface still becomes uniformly charged, although at a slower rate than in the corona transfer case.

When a liquid toner is used, it is well known that mere intimate contact between the toned image and the porous paper is enough to transfer a large portion of the toner to the paper. However, as the charged toner is separated from the latent image surface, the large fields existing between the charged toner and surface will cause localized air breakdown. This has the effect of uniformly charging the insulating surface, leading to a degredation of the latent image and limiting the number of copies which can be made without reimaging.

In addition, if the developer mix (liquid or dry) is slightly conductive, the latent image can be discharged during the toning step rendering it unsuitable for retoning.

There are proposed means to get around this inevitable latent image degredation. Rait U.S. Pat. No. 3,804,511 is one such proposal. All of them, however, are aimed at slowing down the degredation rather than eliminating it. The present invention uses uncharged toner particles in a highly insulating fluid and hence eliminates the cause of the latent image degredation, which is the breakdown of the air in the transfer step caused by the separation of the charges and the discharge of the latent image in the toning step.

SUMMARY OF THE INVENTION

It is the purpose of this invention to produce a plain paper copy, or a multiple number of plain paper copies, of an image of an original document.

It is the further purpose of this invention to employ a dielectric surface wet-toned and pressure-transferred to plain paper.

It is a further object of this invention to produce multiple copies of one image without reimaging from the original document.

The present invention is a method for making multiple copies on plain paper from any electrostatic latent image, without the need for reimaging, using a toning method which does not employ Coulombic attraction. Because the principle of the novel toning method bypasses the limitations of the prior art in that no air breakdown or other erratic surface charging phenomena occur, many more usable multiple copies can be obtained from one latent image.

DESCRIPTION OF THE PREFERRED EMBODIMENT

Figure 1:
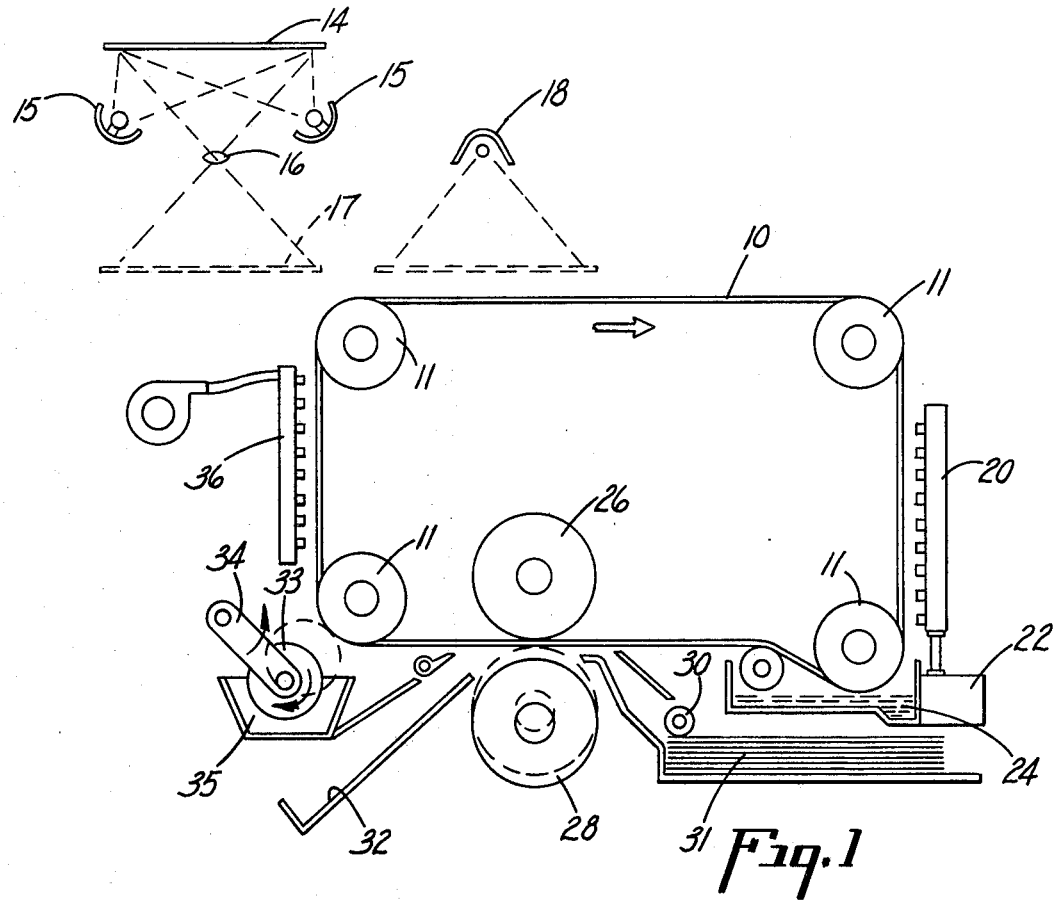
FIG. 1 is a schematic illustration of the process.
Figure 2:
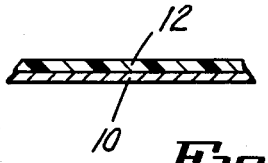
FIG. 2 is a section of a belt taken along the line 2—2 of FIG. 1.

In addition to Coulombic forces, most books on electricity discuss what are usually known as polarization forces. Briefly stated, if a particle of high dielectric constant or permanent dipole moment is brought into an electric field gradient, the particle will be attracted into that field gradient. The larger the permanent or induced electric dipole moment, the stronger the force. (Since the latent image must be in the form of a pattern to contain any information, the electric fields above the pattern are inherently nonuniform.)

One purpose of the present invention is to show that the nonuniform electric fields above an electrostatic latent image can attract uncharged toner particles through these polarization forces and render the latent image visible. It is shown how common materials can be combined in a novel manner to give uncharged toner particles with a high enough induced dipole moment to develop, through the polarization forces, any standard electrostatic latent image presented to it.

It is further shown how the unique properties of this polarization force can be used to easily make multiple copies from a single latent image, by removing the fundamental limitations usually encountered in making such multiple copies. Since the toner particles are uncharged, no external fields, which could degrade the image, are needed to transfer them to the paper. Also, since the toner particles are uncharged, there is no air breakdown between the paper and image dielectric when the paper is separated from the dielectric surface. Since the uncharged particles are supported in a highly insulating fluid, there can be no discharging of the latent image in the toning step. Hence, this invention describes how standard materials can be combined in a novel way to give a toner, which can be used in the normal way, to tone any latent image presented to it in such a way as to easily make multiple copies, by removing the fundamental limitations usually encountered in the making of such multiple copies.

If an uncharged toner particle of electric dipole moment $p$ is brought into an electric field E, with electric field gradient $\nabla E$, the polarization force attracting the particle into the gradient is given by:

$$F = p\,(\nabla E) \qquad (1)$$

If the particle has no permanent dipole moment, but has a dielectric constant $k$, it obtains from the field an induced dipole moment. If the particle is a sphere of radius $r_1$, it can be shown that the induced dipole moment is:

$$4\pi r_1^3 \frac{K_1 - 1}{K_1 + 2}\,\epsilon_0 E_0. \qquad 2)$$

($\epsilon$ is the permitivity of free space). (e.g. *Electromagnetic Theory,* by J. A. Stratton, McGraw Publishing, 1941). But if the dipole moment is induced, not permanent, the force is $\frac{1}{2}p(\nabla E)$ and therefore, the force pulling such a particle into the electric field gradient caused by the electrostatic latent image is then given by:

$$F = 2\pi r_1^3 \frac{K_1 - 1}{K_1 + 2}\,\epsilon_0 E_0. \qquad 3)$$

Toner particles are seldom spherical. However, the above formulas still apply where $r_1$ becomes an appropriate average over the characteristic radii of the particle.

In his paper, "Xerographic Development Processes: A Review", Thomas L. Thourson calculates this force for a "standard" toner particle in a "standard" field. (*IEEE Trans-Actions on Electron Devices,* Vol. ED-19, No. 4, April 1972, pp. 495–511). Assuming $k_1 = 3$, $r_1 =$ 5 microns and $E = 1$ (volt/micron) he calculates that this polarization force is a factor of 10 less than the Coulombic forces for the charged particles. $F_p$ is not present regardless of whether the particle is charged or not.

It should be noted, however, if $k$ is increased from 3 to 10, the $(k-1)/(k+2)$ factor increases by a factor of $2\frac{1}{4}$. If radius $r_1$ were increased from 5 microns to $7\frac{1}{2}$–10 microns, the $r_1^3$ term increases by a factor of 3.4 to 8. Doing both of these things would raise F by a factor of 8 to 18. In addition, E could be increased by raising the image voltage across the insulating layer and $\nabla E$ could be increased by "half-toning" the latent image.

The point of this calculation is to show that a proper choice of $k_1$, $r_1$, E and $\nabla E$ raises the polarization forces to a level equal to the usual Coulombic forces.

A particle of radius 7.5 microns and dielectric constant of 8, in an electrostatic field of 1 volt/micron has an induced dipole moment of $4 \times 10^{-18}$ Coulomb-cm. Thus, particles having permanent dipole moment of this magnitude or greater will work equally well, as far as this invention is concerned.

Particle diameters of 15 to 20 microns are usually found in dry toners. This range may be extended, but not much beyond a range of 5 to 25 microns. The previous calculation suggests that if a dry toner of this particle diameter, with a dielectric constant of 8 or more, were suspended in a highly insulating liquid, said liquid chosen to impart a negligible electrostatic charge to the particles, then one would have a liquid toner which could tone a standard electrostatic latent image, without the problems inherent in using a toner made up of charged particles. Therefore, in the context of this description, a high dielectric toner suitable for this invention is a toner with particles ranging from 10 to 25 microns and preferably 15 to 20 microns, with a dielectric constant of about 8 or higher.

The examples of this invention show that this is possible and can be used in a system to make multiple copies from one latent image without the need for reimaging.

Because detailed illustration of a commercial machine would place many objects into an illustration of the principles of the invention, the drawings in this description are set forth as schematic representations only. Those skilled in the art of photocopying will be amply qualified to provide the machine design for specific applications.

The principle of the process in this invention is to provide a carrier comprising a conductive sheet with a dielectric surface. In the embodiment illustrated, an endless belt 10 is reeved around a series of grounded metal rollers 11 and coated with a dielectric surface 12. The surface may consist, for example, of Mylar or Teflon or Nylon. These materials are examples of that kind of dielectric material which will accept a static electric charge on the surface thereof and not lose that charge over an extended period of time. Nylon is the registered trademark of Dupont Corporation. Teflon is the trademark of Dupont Corporation for a product known chemically as polytetrafluoroethylene. Mylar is a Dupont trademark for a polyester film.

The next step in the process, is then to establish an electrostatic charge pattern on the surface of the dielectric surface. In the drawing there is shown a copy holder 14. The double line of the drawing represents the glass portion of a conventional holder upon which an original document is placed face down and covered with some opaque weight material, as is well known in the art.

Light source 15 and a lens 16 provide focus of the original document onto an ion modulating screen 17. Screen 17 has the capability of selectively passing therethrough charged particles, such as gas ions, in accordance with a pattern that corresponds to the image and nonimage of a graphic original placed upon the copy holder 14.

In the U.S. Pat. No. 3,986,871 there is described in detail a charged particle modulator device and imaging method for using the device. Basically, the apertured modulator is formed from a metal screen having a wire cross-section of about 0.051mm and is overcoated with a very thin layer of a photoconductor, such as selenium over which is next applied an equal thickness of an insulating layer, such as polystyrene.

The three-layered modulator constructed in this manner is impressed with a charge pattern by the procedure of first applying a uniform corona charge to the surface of the screen 17 and thereafter exposing the uniformly charged screen by means of the system including lens 16 described. Any known corona charging device will provide satisfactory uniform charging pattern remaining which corresponds to the graphic subject on the holder 14 to be reproduced. This is sometimes referred to as a charged distribution system on the insulating surface. It is completely passive to electromagnetic radiation.

After the screen 17 is charged and exposed, it is next moved to a position juxtaposed an upper run of the belt 10 as shown in FIG. 1 where the modulator screen 17 is placed between an emission electrode corona 18 and the dielectric surface 12 of the belt 10. When the corona 18 is activated, the gas ions produced will be able to pass through the screen on a selective basis as known in this type of art, to be received on the dielectric surface 12 in a charge pattern corresponding to the graphic subject from which the charge distribution system was created on the insulating layer of the screen 17.

The belt 10 is then caused to move until the deposited ion image comes to the area of a spray head 20. As the belt moves past the spray head 20, which may be referred to as a toning station, it is sprayed with small toner particles which may either be of high dielectric content or permanent dipole moment. Normally a high dielectric material will be used and the polarization will be induced. However, a permanent dipole material would be equally as useful.

These particles are suspended in a carrier of a type which will not discharge the dielectric belt. The best known combination for toning is a dispersion of Xerox Corporation Brand 3600 Toner in Isopar G, which is a trademark of Humble Oil Corporation brand liquid paraffin. A commercial lithographic ink sold by Addressograph Multigraph Corporation dispersed in Isopar G has also been found to be useful.

The composition of Xerox 3600 is approximately:

By Weight

53% Polystyrene
29% Butyl Methacrylate
4% Polyamid
12% Carbon Black
2% Polyvinyl Butyrol A pump 22 circulates a suspension of the particles in the organic carrier from a sump 24 and causes the material to uniformly cover the area of the belt 10 on which the latent ion image has been deposited.

The belt proceeds past the toning station to a printing station where a back roller 26 is positioned. When an image has been placed on the belt and properly toned in the toning station, synchronization timing apparatus, which is within the skill of the machine designer and not shown, will cause pressure platen 28 to move against the surface of the belt 10 and a paper feed 30 to take a sheet of plain paper from a stack 31 and feed that paper between the roller platen 28 and the surface 12 of belt 10 in the area where the image has been developed by the toner. The toner is thus attracted to the fiber structure of the plain paper and the image is transferred from the dielectric surface 12 onto the paper. The printed paper is then deposited into a collection hopper 32 for later distribution.

The ion image is not substantially when the surface toner is removed by the paper, and therefore the belt can recirculate around the race to the toning station and become retoned and then employed for reprinting. This cycle can take place many times before the toner holding power of the ion image is weakened beyond use.

When sufficient copies have been produced and it is desired to remove the image and replace it with a new image, a scrub roller 33 mounted on a pivot arm 34 is caused to swing out of a solvent sump 35 and roll against the surface 12 of the belt 10. Two useful solvents with Isopar G are any alcohol or methylene chloride. These materials attract the ions of the image and dissipate the image in the sump.

After the surface has been sufficiently scrubbed to remove all of the toner, and residual charge, an air blast from dryer 36 is applied to the surface to hasten the reusability time of the belt surface. Thereafter the cycle may be repeated.

What is claimed is:

1. The process of producing copies of an original document on plain paper, comprising the steps:

a. providing a carrier comprising a conductive sheet with a dielectric surface;

b. establishing an electrostatic charge pattern on the surface of said dielectric surface;

c. providing substantially uncharged toner particles of material in a size range of 5 to 25 microns and a dielectric constant of about 8 or higher, and bringing a plurality of the selected particles into contact with said charge pattern, to polarize and attract said particles to the charge pattern, without discharging said pattern, and therefore hold said particles with polarization forces of a low first order of magnitude;

d. placing said dielectric surface after being toned, into contact with a sheet of plain paper under pressure to establish mechanical adhesion forces between said paper and toner particles with a second order of magnitude greater than the said first order produced by said polarization forces;

e. retoning the undischarged charge pattern and repeating the process of steps (c) and (d) a plurality of cycles to produce multiple copies; and f. removing residual toner and the electrostatic charge from said dielectric surface at the end of the production of a predetermined number of copies, rendering said dielectric surface capable of receiving a new image.

2. The process of producing copies of an original document on plain paper, comprising the steps:

a. providing a carrier comprising a conductive sheet with a dielectric surface;

b. establishing an electrostatic charge pattern on the surface of said dielectric surface;

c. providing substantially uncharged toner particles of permanent dipole moment of $4 \times 10^{-18}$ Coulomb-cm or greater, and bringing a plurality of the selected particles into contact with said charge pattern, to polarize and attract said particles to the charge pattern, without discharging said pattern, and therefore hold said particles with polarization forces of a low first order of magnitude;

d. placing said dielectric surface after being toned, into contact with a sheet of plain paper under pressure to establish mechanical adhesion forces between said paper and toner particles with a second order of magnitude greater than the said first order produced by said polarization forces;

e. retoning the undischarged charge pattern and repeating the process of steps (c) and (d) a plurality of cycles to produce multiple copies; and f. removing residual toner and the electrostatic charge from said dielectric surface at the end of the production of a predetermined number of copies, rendering said dielectric surface capable of receiving a new image.

* * * * *

UNITED STATES PATENT AND TRADEMARK OFFICE

CERTIFICATE OF CORRECTION

PATENT NO. : 4,048,921

DATED : September 20, 1977

INVENTOR(S) : Curt R. Raschke

It is certified that error appears in the above-identified patent and that said Letters Patent are hereby corrected as shown below:

Col. 6, line 14 After "substantially" the word --degraded-- should be added.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*